US005977472A

United States Patent [19]

Ito et al.

[11] Patent Number: 5,977,472

[45] Date of Patent: Nov. 2, 1999

[54] CHORD DETECTING APPARATUS AND METHOD, AND MACHINE READABLE MEDIUM CONTAINING PROGRAM THEREFOR

[75] Inventors: Shinichi Ito; Satoshi Suzuki, both of Hamamatsu, Japan

[73] Assignee: Yamaha Corporation, Japan

[21] Appl. No.: 09/003,629

[22] Filed: Jan. 7, 1998

[30] Foreign Application Priority Data

Jan. 8, 1997 [JP] Japan ..... 9-001684

[51] Int. Cl.[6] ..... G10H 1/38

[52] U.S. Cl. ..... 84/637; 84/669; 84/DIG. 22

[58] Field of Search ..... 84/613, 637, 650–652, 84/669, 715, DIG. 22

[56] References Cited

U.S. PATENT DOCUMENTS

| | | | |
|---|---|---|---|
| 4,499,807 | 2/1985 | Ishida | 84/DIG. 2 |
| 4,887,504 | 12/1989 | Okamoto et al. | 84/715 |
| 4,920,849 | 5/1990 | Mizuno | 84/613 |
| 5,597,971 | 1/1997 | Saito | 84/669 |

FOREIGN PATENT DOCUMENTS 57-101897 6/1982 Japan .

*Primary Examiner*—Stanley J. Witkowski
*Attorney, Agent, or Firm*—Rossi & Associates

[57] ABSTRACT

A chord detecting apparatus includes a computer which, by executing a program, detects chords as designated by player's operation on a keyboard or by key data inputted from an external source. The program includes two kinds of chord detection algorithms, the one for a single finger mode and the other for a fingered chord mode. The apparatus conducts the processing of chord detection under the single finger mode algorithm in preference to the fingered chord mode algorithm, namely the apparatus first tries to detect a chord by the single finger mode rule, and if a chord is detected, such a chord is used for succeeding processes, and if no chord is detected by the single finger rule, the apparatus next tries to detect a chord by the fingered chord mode rule. The apparatus will thus eliminate troublesome manipulation of the detection mode change over switch especially for beginner players to have the intended chords under the single finger rule detected correctly, as well as for advanced players to have the intended chords under the fingered chord rule detected correctly.

12 Claims, 5 Drawing Sheets

Fig.5

| CHORD TYPE \ NOTE | C | C# | D | D# | E | F | F# | G | G# | A | A# | B |
|---|---|---|---|---|---|---|---|---|---|---|---|---|
| MAJOR | 1 | 0 | 0 | 0 | 1 | 0 | 0 | 1 | 0 | 0 | 0 | 0 |
| MAJOR (OMITTED) | 1 | 0 | 0 | 0 | 1 | 0 | 0 | 0 | 0 | 0 | 0 | 0 |
| MINOR | 1 | 0 | 0 | 1 | 0 | 0 | 0 | 1 | 0 | 0 | 0 | 0 |
| MINOR (OMITTED) | 1 | 0 | 0 | 1 | 0 | 0 | 0 | 0 | 0 | 0 | 0 | 0 |
| SEVENTH | 1 | 0 | 0 | 0 | 1 | 0 | 0 | 1 | 0 | 0 | 1 | 0 |
| MINOR SEVENTH | 1 | 0 | 0 | 1 | 0 | 0 | 0 | 1 | 0 | 0 | 1 | 0 |
| ⋮ | ⋮ | ⋮ | ⋮ | ⋮ | ⋮ | ⋮ | ⋮ | ⋮ | ⋮ | ⋮ | ⋮ | ⋮ |

CHORD DETECTING APPARATUS AND METHOD, AND MACHINE READABLE MEDIUM CONTAINING PROGRAM THEREFOR

BACKGROUND OF THE INVENTION

1. Field of the Invention

The present invention relates to a chord detecting apparatus and method capable of automatically detecting a chord based on the inputted note information, and more particularly to such a chord detecting apparatus and method in which the chord detecting modes are automatically selected according to the depressed key patterns. The invention is applicable in an electronic musical instrument, an automatic accompaniment apparatus connected to an electronic musical instrument, an automatic performance apparatus which automatically performs music based on performance data previously stored in the apparatus or externally supplied from an outside apparatus.

2. Description of the Prior Art

Electronic musical instruments, automatic accompaniment apparatuses and automatic performance apparatuses are conventionally equipped with a chord detecting apparatus which automatically detects chords based on note data inputted thereto representing names in a musical scale, and are capable of automatically generating chord tones, arpeggio tones, bass tones and various other automatic accompaniment tones. Keyboard electronic musical instruments typically employ two types of chord designating methods usually referred to as a fingered chord mode and a single finger mode, respectively. The fingered chord mode is to designate a chord by simultaneously depressing a plurality of keys corresponding to all or some of the chord constituent notes of an intended chord, and is suited for advanced players. The single finger mode is to designate a chord by simultaneously depressing a single key corresponding to the root note of an intended chord plus zero or one or more additional keys below the root note key to determine the type of the intended chord such as a major, minor and seventh chords, and is suited for beginner players.

Therefore, the conventional chord detecting apparatus is typically constructed such that the designated chord is detected from the combination of all or some of the chord constituent notes represented by the inputted note information (data) for the fingered chord mode detection on the one hand, and that the designated chord is detected from the combination of the root note and a few (including zero, in this instance) additional note(s) under a predetermined rule represented by the inputted note information (data) for the single finger mode detection on the other hand. There have been prevailing two types of methods for determining (or selecting) a mode for use from among those chord detecting modes. One is to determine the mode by a manual selector switch for selecting either of the fingered chord mode and the single finger mode. The other is to determine the mode automatically based on the depressed key pattern by primarily detecting the chord according to the fingered chord detecting rule and secondarily detecting, only in case the primary detection has failed, the chord according to the single finger chord detecting rule.

With the apparatus employing the above first method for determining the chord detecting mode, however, it is troublesome to manually change over the mode selector switch amidst playing music, and moreover there may be an unintended chance where a chord which is not intended by the player is detected if the player should fail to properly change over the mode selector switch. On the other hand, the apparatus employing the above second method for determining the chord detecting mode have another problem especially with the apparatus utilizing advanced chord detecting algorithm having rules for many complicated chord designations. Namely, if the player depresses the keys according to the single finger detection rule (according to his/her intention) but the depressed keys happen to be the same as one of the fingered chord determining patterns, the apparatus automatically detects the chord according to the fingered chord rule contrary to the player's intention.

SUMMARY OF THE INVENTION

It is, therefore, a primary object of the present invention to provide a chord detecting apparatus and method and a machine readable medium containing a program therefor which will release the operator from a troublesome manipulation of the switch for the mode selection and will present a correct chord intended by the player, especially the beginner.

According to the present invention, the object is accomplished by providing a chord detecting apparatus which comprises note information inputting means for inputting note information representing one or a plurality of notes in a musical scale to designate a chord, first chord detecting means for detecting a chord from a root note alone or with other notes according to a predetermined detection rule based on the inputted information, the predetermined detection rule being different from a regular chord constituting note pattern, second chord detecting means for detecting a chord from a combination of all or some of the chord constituent notes of the chord based on the inputted information, and chord detection control means responsive to the input of the note information for automatically rendering the first chord detecting means operative to detect the designated chord, and if and only if the first chord detecting means has failed to detect a chord then rendering the second chord detecting means operative to detect the designated chord.

According to the present invention, the object is further accomplished by providing a method for detecting chords which comprises a first step of inputting note data representing one or a plurality of notes in a musical scale to designate a chord, a second step of detecting the designated chord by detecting a chord from a root note alone or with other notes according to a predetermined detection rule based on the inputted data, the predetermined detection rule being different from a regular chord constituting note pattern, and a third step of detecting, if and only if the second step has failed to detect a chord, the designated chord by detecting a chord from a combination of all or some of the chord constituent notes of a chord based on the inputted data.

According to the present invention, the object is still further accomplished by providing a machine readable medium for use in a chord detecting apparatus of a data processing type comprising a computer, which medium contains program instructions executable by the computer for executing an input process of inputting note data representing one or a plurality of notes in a musical scale to designate a chord, a first chord detection process of detecting a chord from a root note alone or with other notes according to a predetermined detection rule based on the inputted data, the predetermined detection rule being different from a regular chord constituting note pattern, a second chord detection process of detecting a chord from a combination of all or some of the chord constituent notes of the chord based on the inputted data, and a chord detection control process responsive to the input of the note data for automatically executing the first chord detection process to detect the designated chord, and if and only if the first chord detection process has failed to detect a chord then executing the second chord detection process to detect the designated chord.

According to the present invention, the chord detection is conducted preferentially by the single finger chord detection mode wherein a chord is detected from a root note alone or with other notes according to a predetermined detection rule (i.e. a single finger chord determining rule) based on the inputted note data, and in case a chord has not been detected by the single finger mode chord detection, subordinately by the fingered chord detection mode wherein a chord is detected from a combination of all or some of the chord constituent notes of the chord based on the inputted data.

According to the present invention, therefore, a troublesome manipulation of a mode change over switch by the player will be avoided and intended chords on the single finger designation will be detected without failure, which is very advantageous especially for beginners. The fingered chord designation with full note depression will lead to the correct detection of the intended chord. Further, the fingered chord designation with partial omission of the chord constituent note(s) may not lead to an erroneous detection of the intended chord, if the key depression patterns be carefully selected (i.e. if the key to be omitted be advertently determined) so as not to become identical with any of the single finger chord detection pattern. Such a care will not be too difficult for advanced players. This means that the chord detecting apparatus and method of the present invention will not be too inconvenient for the advanced players who usually designate chords on the fingered chord detection mode.

BRIEF DESCRIPTION OF THE DRAWINGS

For a better understanding of the present invention, and to show how the same may be practiced and will work, reference will now be made, by way of example, to the accompanying drawings, in which:

FIG. 5 is a memory map showing the contents of a table storing chord pattern data.

DESCRIPTION OF THE PREFERRED EMBODIMENTS

Figure 1:
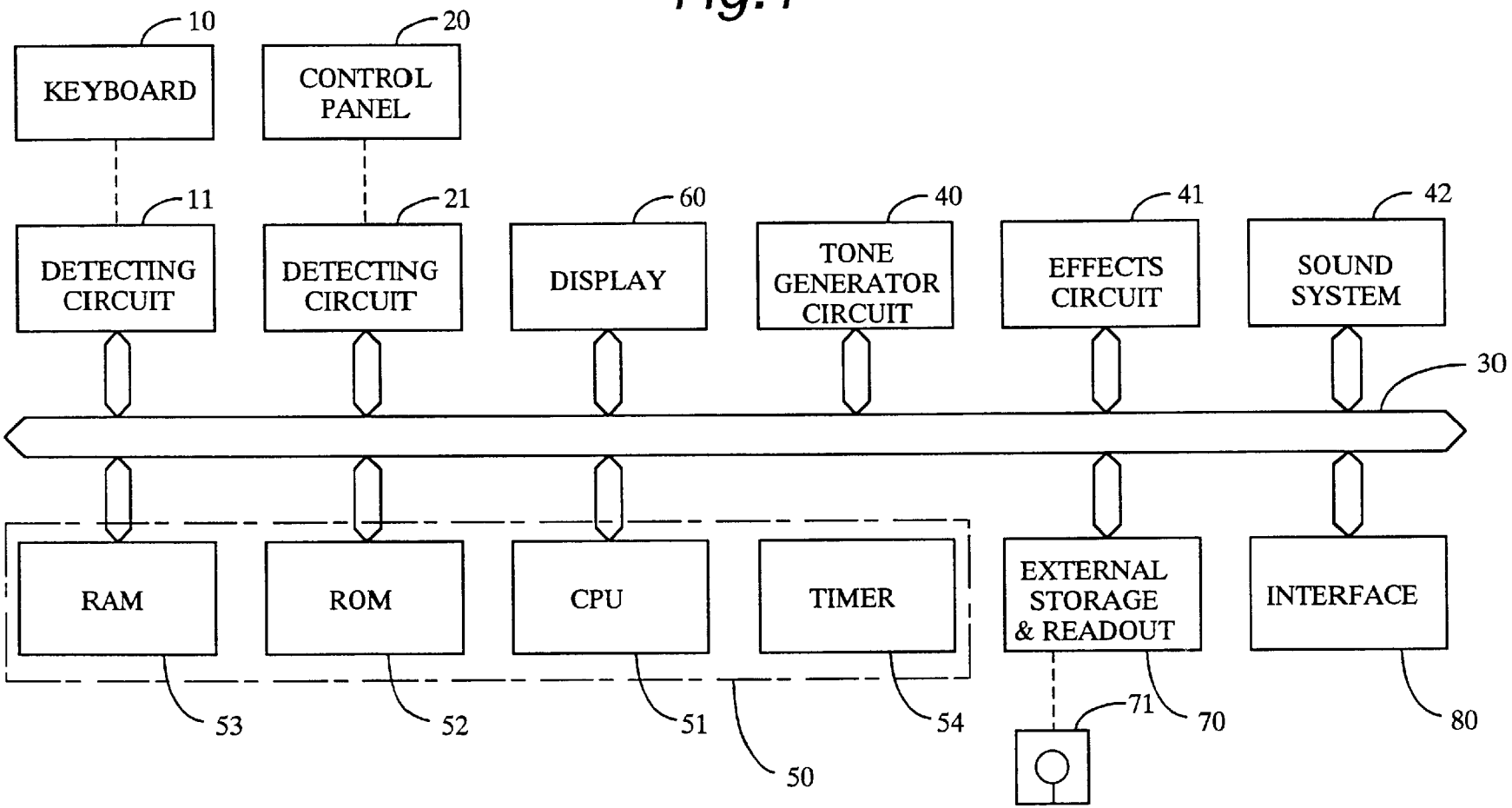
FIG. 1 is a block diagram showing an outline of an embodiment of an electronic musical instrument incorporating a chord detecting apparatus of the present invention.

Illustrated in FIG. 1 of the drawings is a general block diagram of an embodiment of an electronic musical instrument incorporating a chord detecting apparatus of the present invention. A computer 50 includes a CPU 51, a ROM 52, a RAM 53 and a timer 54 for controlling the electronic musical instrument by data processing technology via a bus line 30, which interconnects various task circuits and devices in the instrument as will be described hereinafter in detail.

The electronic musical instrument comprises a keyboard 10 and a control panel 20 for manipulation by the player or operator. The keyboard 10 includes a plurality of playing keys covering several octaves of a musical scale in which each octave has twelve keys (seven whites and five blacks) corresponding to the respective notes in a musical scale. Three or four octaves in the higher side of the keyboard 10 are utilized as a melody region, while two or three octaves in the lower side are utilized as a chord region. The depression and the release of each of those keys are detected by means of key switches correspondingly provided for the respective keys in a detecting circuit 11 which in turn is connected to the bus 30. The control panel includes various control knobs such as tone color selecting knobs for selecting the tone colors of melody tones and accompaniment tones, effect selecting knobs for selecting the effect to be imparted to the tone signals, mode selecting knobs for selecting the single finger mode, the fingered chord mode, multifinger mode, etc., and accompaniment tone selecting knobs for selecting the generation of arpeggio tones, bass tones and other accompaniment tones. The actuation of these knobs are respectively detected by means of control switched correspondingly provided for the respective control knobs in a detecting circuit 21 which in turn is connected to the bus 30.

To the bus 30 are connected a tone generator circuit 40, an effects circuit 41, the computer 50, a display 60, and an external storage and readout device 70 and an interface 80. The tone generator circuit 40 receives via the bus 30 key name data (note name data) for determining the note pitches of the tones to be generated, a key on/off signal for instructing the start and stop of each tone, tone color control data for controlling the tone colors, etc., and forms a tone signal as designated by the key name data, the key on/off signal, tone color control data, etc. to output the tone signal to the effect circuit 41. The effects circuit 41 is controlled by effect control data supplied thereto via the bus 30, and impart to the tone signal a tone effect according to the effect control data, and outputs the effect imparted tone signal. To the effects circuit 41 is connected a sound system 42 comprising an amplifier, a loudspeaker, etc., where the sound system 42 converts the effect imparted tone signal to an audible sound to be emitted into space.

Within the computer 50, the CPU 51 executes a program and controls the operation of the electronic musical instrument, the ROM 52 stores the program, the RAM 53 stores variables necessary for the execution of the program temporarily, and the timer 54 counts time lapses and outputs time count signals periodically for the CPU 51 to execute various necessary programs at every predetermined time interval. The display 60 displays the selected states of the tone color, the mode, the accompaniment tone, etc. The external storage and readout device 70 includes storage media such as a hard disk and an optical disk, and a disk driver for reading out the stored data from the media or writing the data and the program in the media. The device 70 is adapted for accepting portable storage media 71 such as a compact disk and a flexible disk, and is capable of reading out the stored data from such storage media 71 and writing data or programs in the media 71. The interface 80 is to permit the connection with other computers and other electronic musical instruments for communicating MIDI data and other programs and data.

Figure 2:
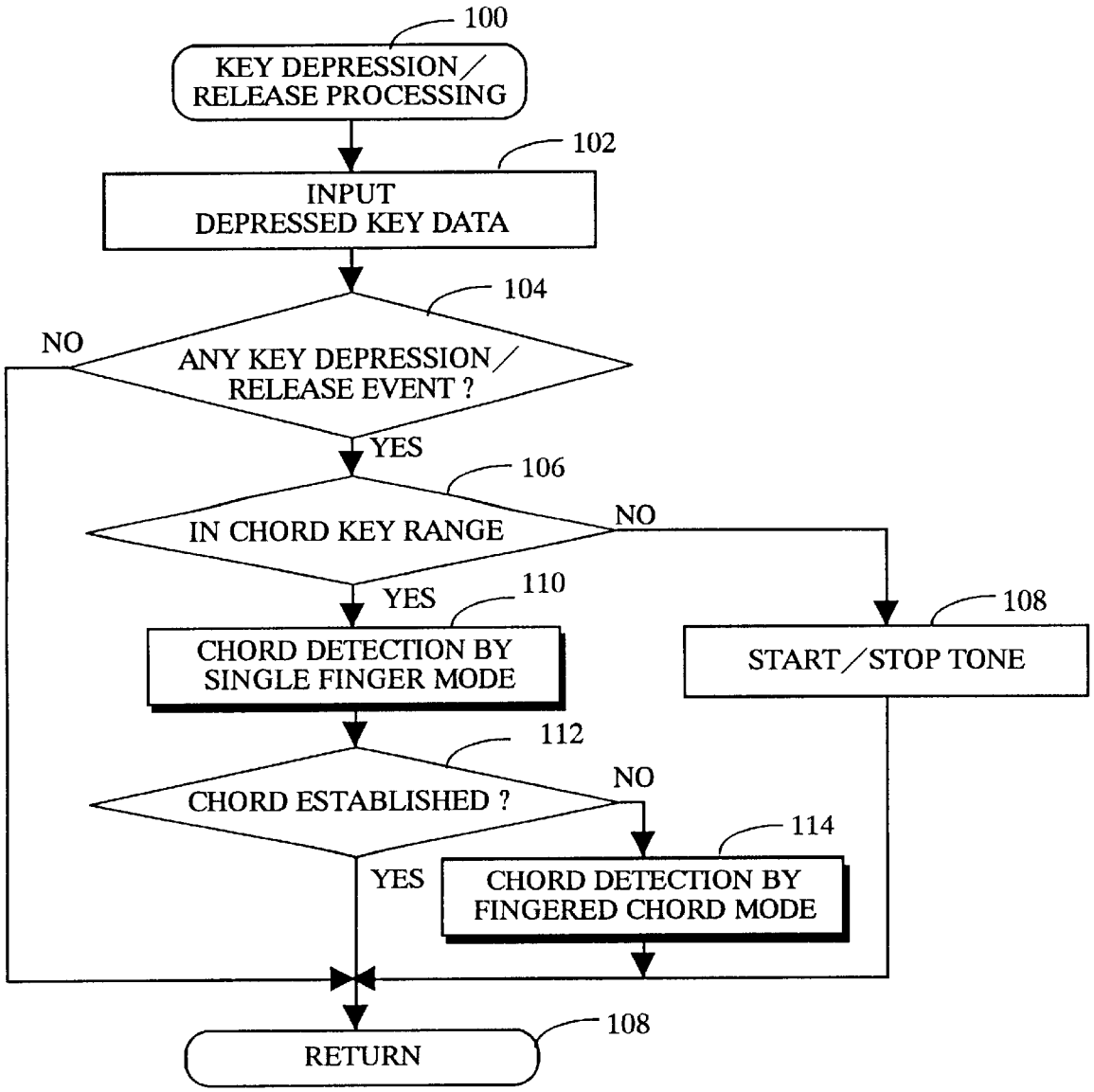
FIG. 2 is a flow chart of a program routine of a key depression/release processing of the present invention.

The operation of the embodiment constructed as above will be described hereunder. When the power switch (not shown) of the electronic musical instrument is turned on, the CPU 51 starts to execute the various programs (not shown)

including a key depression/release program of FIG. 2 at every predetermined time interval including under the control of the timer 54. When the player manipulates various control knobs in the control panel 20 to set the tone color of the melody tones and the accompaniment tones, the effects to be imparted to the tone signals, addition or cancellation of the accompaniment tones, etc., the CPU 51 executes the corresponding program (not shown) to output the tone color data, the effect control data, etc. to the tone generator circuit 40 and the effects circuit 41, thereby preparing for the generation of tone signals. The CPU 51 further permits the execution of the programs corresponding to the selected modes and the program for accompaniment tones and prepares for the operation of the electronic musical instrument in accordance with the respective modes and the provision of the accompaniment tones.

Now a detailed description will be made with respect to the operation of the apparatus where the mode selection is set at the "multifinger mode". The multifinger mode is a mode in which both of the single finger mode and the fingered chord mode are rendered operative and either of the two modes is automatically utilized for each depression of the keys depending on the depressed key pattern. Referring to FIG. 2, the CPU 51 starts to execute the key depression/release program at step 100. Step 102 is to input the depressed key data (note information) representing the note names of the depressed keys. Step 104 is to check a change in key depression state in the keyboard 10 based on the above inputted depressed key data. If no change is found in the key depression state of the keyboard 10, the step 104 judges "NO" i.e. there is no key depression/release event and the process jumps to step 116 to end the execution of this program routine. If, on the other hand, the player has started performance and makes changes in the key depression/release state in the keyboard 10, the step 104 judges "YES" i.e. there is a key depression/release event and the program proceeds to step 106.

The step 106 judges whether the depressed or released key belongs to the melody key range or the chord key range. If the depressed/released key belongs to the melody key range, the step 106 judges "NO" and the process moves to step 108 to output the key name data and the key on/off signal to the tone generator circuit 40 thereby instructing the tone generator circuit 40 to start or stop generation of the melody tone signal. With this instruction, the tone generator circuit 40 starts or stops the generation of the melody tone according to the depression/release of the key in the keyboard 10. After the step 108, the CPU 51 ends the key depression/release processing program routine at step 116.

If the depressed or released key belongs to the chord key range, the CPU 51 judges "YES" at the step 106 to go forward to step 110 which is a routine for the processing of chord detection by the single finger mode. This routine is to detect a chord according to the single finger designation rule and detects the designated chord from the combination of the key name for the root note of the chord and other depressed key name(s) (including zero key depression in this instance) unrelated to the chord constituent notes. The chord determining rule i.e. the key depression pattern is different from the regular chord constituent notes. More specifically speaking, with the embodiment described herein, the simultaneous depression of only one key is detected as a major chord having the root note of that one key, the simultaneous depression of a key and the first lower white key (from that higher key) is detected as a seventh chord having the root note of that higher key, the simultaneous depression of a key and the first lower black key is detected as a minor chord having the root note of that higher key, and the simultaneous depression of a key, the first lower white key and the first lower black key (three keys in all) is detected as a minor seventh chord having the root note of that highest key.

Figure 3:
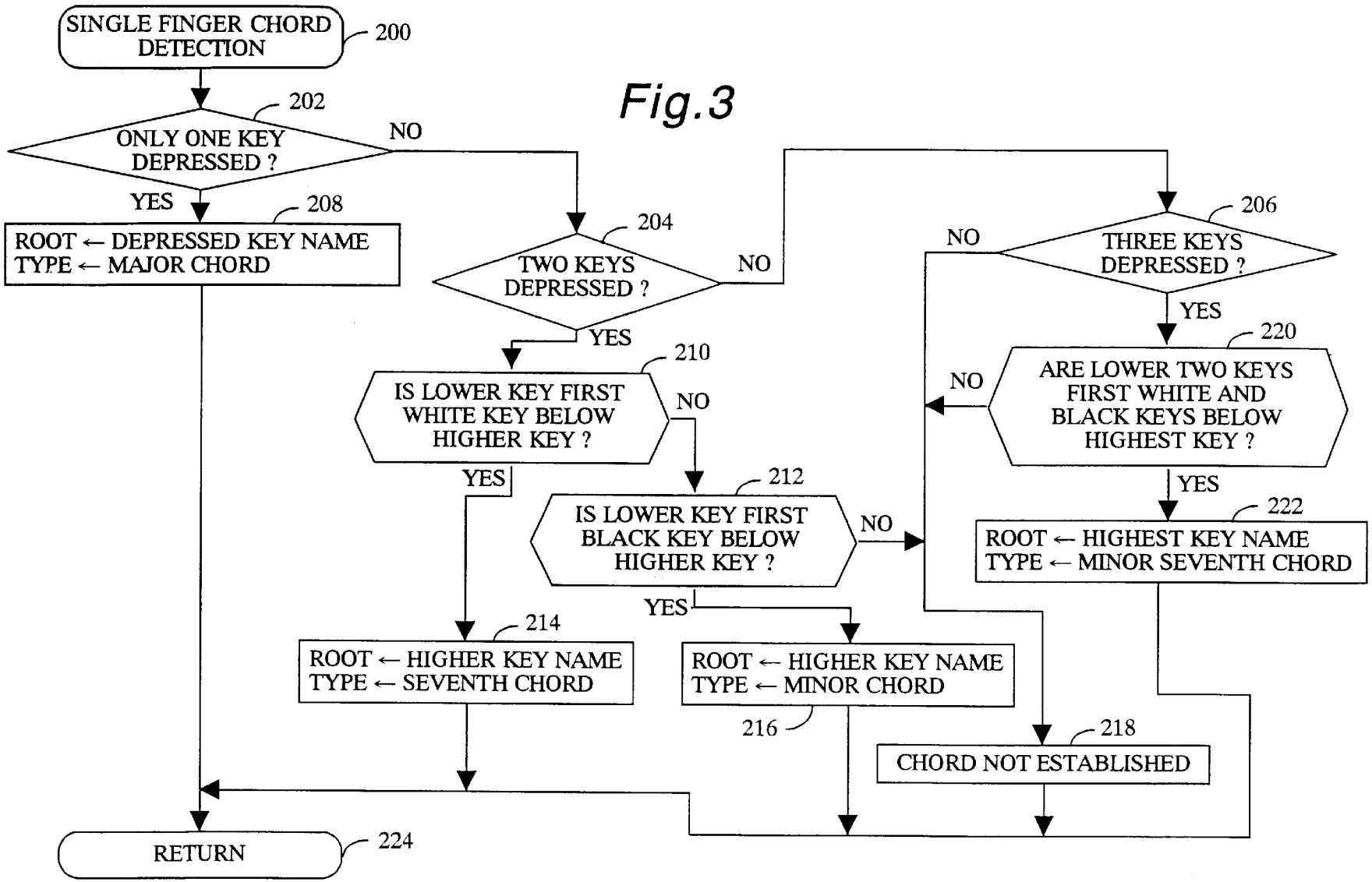
FIG. 3 is a flow chart showing the details of a process routine of the chord detection by the single finger mode in FIG. 2.

The single finger chord detection routine is shown in detail in FIG. 3. The execution of the routine starts at step 200 and judges, based on the depressed key data inputted at the step 102 (described above), whether only one key is depressed at step 202, whether two keys are depressed at step 204 and whether three keys are depressed at step 206 in succession, respectively. When only one key is depressed, the step 102 judges "YES" and then step 208 sets the root note data "ROOT" at a data value which represents the note name of the depressed key and sets the type data "TYPE" at a data value which represents the major chord.

When two keys are depressed simultaneously, the step 202 judges "NO" and step 204 judges "YES", and then step 210 judges whether the lower of the two keys is the first white key below the higher key and step 212 judges whether the lower of the two keys is the first black key below the higher key. When the lower depressed key is the nearest white key to the higher key, the step 210 judges "YES" and the process goes to step 214 to set the root note data ROOT at a data value which represents the note name of the higher key and the type data TYPE at a data value which represents the seventh chord. When the lower depressed key is the nearest black key to the higher key, the step 212 judges "YES" and the process goes to step 216 to set the root note data ROOT at a data value which represents the note name of the higher key and the type data TYPE at a data value which represents the minor chord. If the lower key is the second or further white key or black key, both the steps 210 and 212 judge "NO" and direct the process to step 218 to set both the root note data ROOT and the type data TYPE at a data value which means that a chord is not established.

When three keys are depressed simultaneously, the steps 202 and 204 judge "NO" and step 206 judges "YES", and then step 220 judges whether the lower two keys are the first white and first black keys below the highest key. If the depressed three keys meet this condition, the step 220 judges "YES" and the process goes to step 222 to set the root note data ROOT at a data value which represents the note name of the highest key and the type data TYPE at a data value which represents the minor seventh chord. If either of the lower two keys is the second or farther white or black key, or if both of the two lower keys are white keys or black keys, the step 220 judges "NO" and direct the process to the step 218 to set both the root note data ROOT and the type data TYPE at a data value which means that a chord is not established. When four or more keys are depressed simultaneously, all of the steps 202, 204 and 206 judge "NO" and direct the process to step 218 to set both the root note data ROOT and the type data TYPE at a data value which means that a chord is not established. After the process of step 208, 214, 216, 218 or 222, the execution of this single finger chord detection routine ends to return to the main routine flow of FIG. 2 for the key depression/release processing.

Again back to the program routine of the key depression/release processing of FIG. 2, after the execution of the chord detection routine by single finger mode at the step 110 as described in detail with reference to FIG. 3 above, step 112 judges whether a chord is established with the root note data ROOT and the type data TYPE. If both of the data ROOT and TYPE are not set at a value representing non-establishment of a chord, the step 112 judges "YES" and then step 116 ends the execution of the key depression/ release processing routine to return to the former main routine. If both of the data ROOT and TYPE are set at a data value indicating non-establishment of a chord, the step 112 judges "NO" and the process goes forward to step 114 to execute the chord detection routine under fingered chord mode and thereafter goes to the step 116 to end the program routine of the key depression/release processing.

The fingered chord detection routine is to detect a chord under the fingered chord designation mode, and conducts the processing for detecting the chord which is designated by the combination of all or part of the chord constituent notes based on the inputted depressed key data (note name information). The fingered chord detection routine is described in detail in FIG. 4, where the execution starts at step 300. At step 302, the depressed key data inputted by the process of the above-mentioned step 102 are converted to depressed key pattern data of twelve bits, each bit corresponding to each of the twelve notes in an octave, by setting "1" for the note name of which a key is depressed in the chord key region irrespective of its octave location and setting "0" for the note name of which no key is depressed in the chord key region. The twelve bits are arranged in the chromatic order of the musical scale from C through B. In this step 302, also the variable data representing the number of the shifts (to be described later) is set at an initial value "0". Then at step 304, the above made depressed key pattern data of twelve bits is compared with the chord pattern data of the respective chord types each having twelve bits and being prepared in a chord table as shown in FIG. 5 which is previously provided in the ROM 52. The respective chord patterns are constructed by the data value "1" for the existing chord constituent notes and "0" for the non-existing notes, with respect to a major chord with full of notes, a major chord with an omitted note, a minor chord with full of notes, a minor chord with an omitted note, a seventh chord with full of notes, a minor seventh chord with full of notes, etc., all in a normalized manner on the root note of C.

If the comparison shows that the depressed key pattern is identical with any of the chord patterns in the chord table, step 306 judges "YES" and then step 308 sets the root note data ROOT at a value which represents the C note plus a value of the shift number (the latter value is initially "0" as set at the step 302) and sets the type data TYPE at a value which represents the type of the chord pattern in the chord table with which the depressed key pattern is identical. For example, the note C through B are given values "0" through "11", respectively. And if the depressed key pattern data is identical with the chord pattern data of a major chord or a major chord (omitted), the root note data ROOT is set at a value "0" and the type data TYPE at a value indicating a major chord.

In case the depressed key pattern is not identical with any of the chord pattern data shown in FIG. 5, the step 306 judges "NO" and step 310 shifts the depressed key pattern leftward in a circulation manner by one bit and increase the shift number data by "1". Namely, the data in the second through twelfth bits from the left (each being "1" or "0") are shifted leftward into the first through eleventh bits, while the data in the first bit from the left is shifted into the twelfth bit, thus constituting a ring shift by one bit. Step 312 is to check if the data shifting of twelve-bit depressed key pattern data has completed one round of circulation, i.e. whether the number of the shifts is equal to or greater than twelve. The step 312 judges "NO" before one round is completed and directs the process to the step 304 to repeat the same. This manner of comparison by each shifting means that every assumption of the root note of the depressed key pattern as each of C# through B is compared with the chord patterns of the respective type in the chord table. For example, if the depressed key pattern data is found to be identical with any of the chord pattern data in the comparison process at the step 304 after only one shift process of the step 310, the depressed keys are determined to constitute a chord having a root note of C# and a type existing in the table. If the shifting of the depressed key pattern has completed one round of circulation without finding any agreement of the depressed key pattern data and the chord pattern data even through the circulating processes by the steps 304–312, the step 312 judges "NO" and the program proceeds to step 314.

Step 314 is to conduct an exceptional chord detecting process. For example, when too many keys are being depressed, the depressed key pattern data will be formed by limiting to a predetermined number of the latest depressed keys, and such formed depressed key pattern data will be compared with the chord pattern data. Or special chord pattern data may be provided in the chord pattern table for the depressed key pattern data to be compared with. And when a chord is detected by this exceptional chord detecting process, step 316 judges "YES" and step 318 sets the root note data ROOT at a value which represents the root note of the detected chord and the type data TYPE at a value which represents the type of the same. When no chord has been detected at all even through this exceptional chord detecting process, the step 316 judges "NO" and step 320 both the root note data ROOT and the type data TYPE at a value which means that any chord is not established. After the step 308, 318 or 320, the process proceeds to step 322 which ends the execution of the fingered chord detection routine.

The above description of the embodiment has been the case where the multifinger mode is selected by the mode selecting switch. But in case the single finger mode is selected, some program (not shown) will control the execution of the main routine of FIG. 2 to conduct only the single finger chord detection flow including the step 110 whose detail is in FIG. 3 and not the fingered chord detection flow to detect the chords designated by the player. On the other hand, in case the fingered chord mode is selected, the program will control the execution of the main routine of FIG. 2 to conduct only the fingered chord detection flow including the step 114 whose detail is in FIG. 4 and not the single finger detection flow to detect the chords designated by the player. Therefore in the embodiment described above, the FIG. 3 routine for the single finger chord detection is commonly used for the multifinger mode setting and the single finger mode setting, and the FIG. 4 routine for the fingered chord detection is commonly used for the multifinger mode setting and the fingered chord mode setting, thereby eliminating separate provision of those detection flows exclusively.

As a chord is determined by the root note and the type as detected according to the above description, the CPU 51 executes a program (not shown) to automatically form data for controlling the generation of chord tones, arpeggio tones, bass tones and other accompaniment tones, and to supply those data to the tone generator circuit 40 for generating various automatic accompaniment tones. The names of the respectively detected chords may be displayed on the display device 60.

As will be understood from the above description about the operation of the embodiment, the key depression/release process program executes the single finger chord detection routine of the step 110 in preference to the fingered chord detection routine of the step 114, and consequently the chord detection by the fingered chord detection routine takes place only when the step 112 fails to detect the establishment of a chord through the single finger chord detection routine. This means that the above embodiment avoids troublesome manipulation of the mode change over knob by the player and realizes correct detection of the chords intended by a beginner player. And further, where the player wants to designate chords according to the fingered chord rule, the player only has to depress full keys for the chord so that the apparatus may not misdetect the intended chord. Further, where the player would like to designate a chord in a partially omitted pattern under the fingered chord mode, the player will only have to carefully chose the omission manner to avoid misdetection. Such careful choice would be within a practical way for an advanced player. Therefore, the multifinger mode with the single finger preference according to this invention is not so inconvenient for the advanced players who tend to designate chords according to the fingered chord rule.

In the above described embodiment, the single finger chord detection rule is that the highest of the depressed keys (including one key in this context) determines the root note of the chord, but an alternative rule may be that the lowest of the depressed keys determines the root note of the chord and that additional zero key, first higher white key and first higher black key determine the major type, the seventh type and the minor type of the chord. Further alternative rules may include the root note detection by the highest or lowest of the depressed keys and the chord type detection for seventh or minor by all or some white or black keys in a predetermined key range not limiting to the nearest white or black key to the root note determining key. Further, with the determination of the root note by the highest or lowest key, the chord type like seventh or minor may be determined by the number of the additionally depressed keys within a predetermined range above or below the root determining key. While the above embodiment comprises a fingered chord detection routine which detects a major or minor chord in an omitted pattern by the steps 304 and 306, the program flow may be alternatively designed such that an omitted pattern will be detected by an exceptional chord detection process of the step 314.

Figure 4:
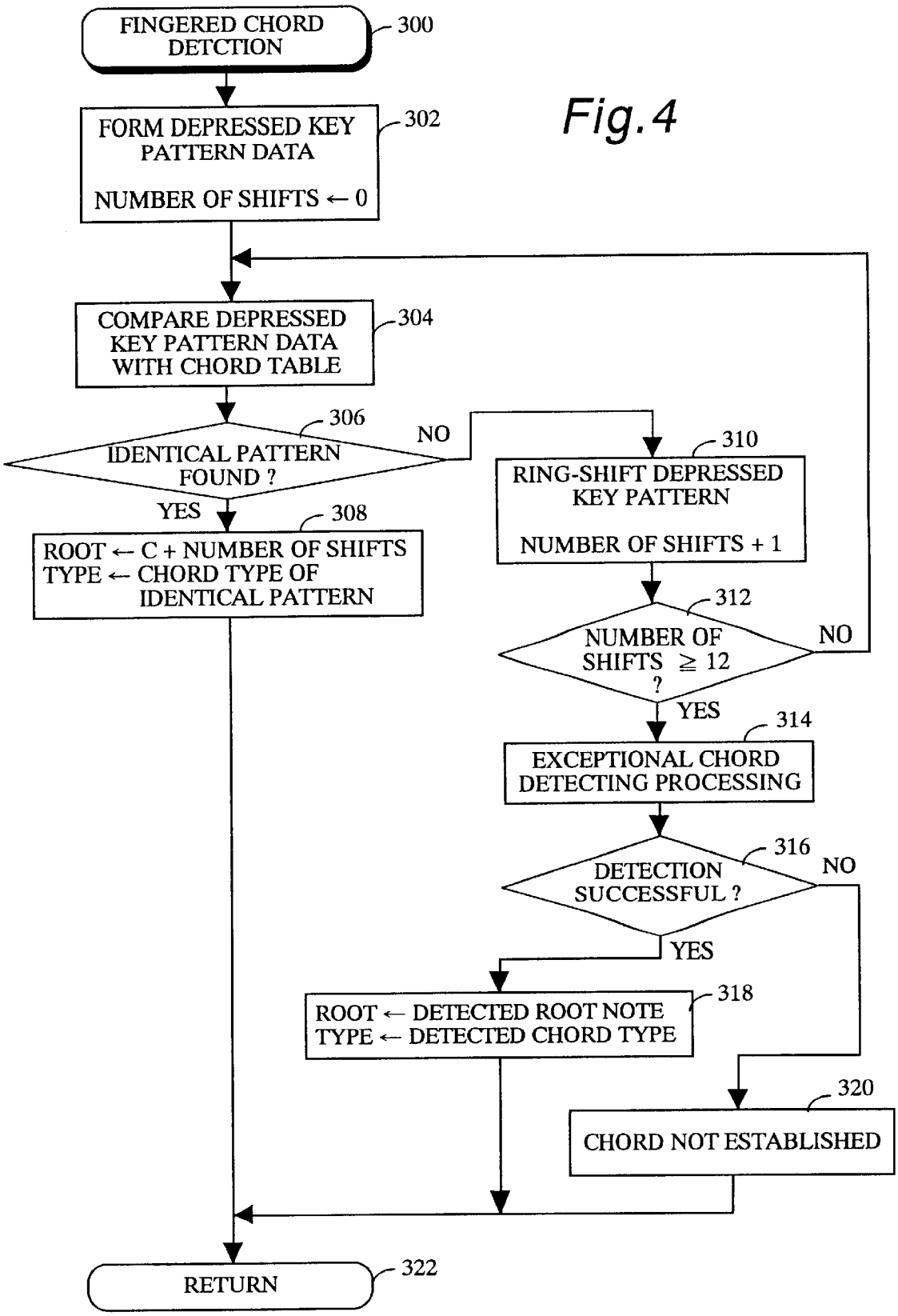
FIG. 4 is a flow chart showing the details of a process routine of the chord detection by the fingered chord mode in FIG. 2

In the above described embodiment, the programs of FIGS. 2–4 and the chord table are provided in the ROM 52, but those programs and table may be stored in a hard disk, an optical disk or the like included in the external storage and readout device 70 and the CPU 51 may execute the chord detecting and other processes using such programs and table. Further alternatively, such programs may be stored in storage media 71 like a compact disk and a flexible disk, which may be connected to the readout device 71, and then the CPU may execute the chord detecting and other processes by directly reading the programs and the table therefrom or once transferring them into RAM and thereafter reading them therefrom. Still further, the programs and the table may be externally down loaded via the interface 80 into the RAM 53, storage media like a hard disk, an optical disk or the like included in the external storage and readout device 70, or the storage media 71 like a compact disk, a flexible disk and the like inserted in the device 70.

In the above embodiment, the chords to be detected are played on the keyboard 10, but alternatively the chord performance data may be previously recorded as automatic performance data in a hard disk, an optical disk or the like included in the external storage and readout device 70, or in the storage media 71 like a compact disk, a flexible disk or the like inserted in the device 70. In such an instance, the performance data (note information) are read out from the storage media and inputted by the step 102, and the apparatus detects the chords using such inputted performance data (note information). Further alternatively, the automatic performance data may be externally supplied via the interface 80, or key note data produced by a manual performance on an external electronic musical instrument or the like may be supplied to the apparatus, and note information included in such automatic performance data or key name data may be inputted by the step 102, and the chords may be detected using the inputted note information.

This invention may not be limited to an electronic keyboard musical instrument, but can also be realized with other types of electronic musical instruments, automatic player pianos or the like. Further, the present invention may be practiced with an automatic accompaniment apparatus, an automatic performance apparatus or the like which can produce tone signals only automatically without having manually controllable elements like a keyboard. The invention is not limited to an electronic musical instrument type apparatus incorporating a tone generator circuit and an automatic accompaniment function, but may be applied to a system constituted by separate apparatuses for a tone generator, a sequencer, etc. and may be interconnected using some communication network like MIDI or else. Also various manners of technology prevailing in the computer field may also be available.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. A chord detecting apparatus comprising:

note information inputting means for inputting note information representing one or a plurality of notes in a musical scale to designate a chord, first chord detecting means for detecting a chord from a root note alone or with other notes according to a predetermined detection rule based on said inputted information, said predetermined detection rule being different from a chord constituting note pattern, second chord detecting means for detecting a chord from a combination of all or some of the chord constituent notes of said chord based on said inputted information, and chord detection control means responsive to the input of said note information for automatically rendering said first chord detecting means operative to detect said designated chord, and if and only if said first chord detecting means has failed to detect a chord then rendering said second chord detecting means operative to detect said designated chord.

2. A chord detecting apparatus according to claim 1, wherein said first chord detecting means detects a chord in a single finger mode in which the root of the chord is determined based on one of at least one depressed key name, and the type of the chord is determined based on other depressed key names, if any, and wherein said second chord detecting means detects a chord in a fingered chord mode in which the root and type of the chord are determined based on a combination of plural depressed key names.

3. A chord detecting apparatus according to claim 1, wherein said note information inputting means is a keyboard including keys, and wherein, if more than a predetermined number of keys in said keyboard are depressed simultaneously, said first chord detecting means detects no establishment of a chord, and said chord detection control means renders said second chord detecting means operative.

4. A chord detecting apparatus according to claim 1, wherein said note information inputting means is a keyboard including keys, and wherein, if more than one key in said keyboard are depressed simultaneously and at least one key of said more than one key is not within a predetermined key name range from the other key of said more than one key, said first chord detecting means detects no establishment of a chord, and said chord detection control means renders said second chord detecting means operative.

5. A chord detecting apparatus according to claim 1, wherein said note information inputting means is a keyboard including keys, and wherein said predetermined detecting rule according to which said first chord detecting means detects a chord is that, when a plurality of keys in said keyboard are depressed simultaneously, the highest of said plurality of depressed keys determines the root note of a chord and the rest of said plurality of depressed keys determines the type of the chord.

6. A chord detecting apparatus according to claim 5, wherein said predetermined detecting rule is that, when a plurality of keys are depressed simultaneously, the highest of said plurality of depressed keys determines the root note of a chord and the number of the depressed keys existing within a predetermined key range below said highest depressed key determines the type of the chord.

7. A chord detecting apparatus according to claim 1, wherein said note information inputting means is a keyboard including keys, and wherein said predetermined detecting rule according to which said first chord detecting means detects a chord is that, when a plurality of keys in said keyboard are depressed simultaneously, the lowest of said plurality of depressed keys determines the root note of a chord and the rest of said plurality of depressed keys determines the type of the chord.

8. A chord detecting apparatus according to claim 7, wherein said predetermined detecting rule is that, when a plurality of keys are depressed simultaneously, the lowest of said plurality of depressed keys determines the root note of a chord and the number of the depressed keys existing within a predetermined key range above said lowest depressed key determines the type of the chord.

9. A chord detecting apparatus according to claim 1, wherein said note information inputting means is a keyboard including keys, said keyboard being divided into at least a melody key region and an accompaniment key region, and wherein said first and second chord detecting means detect a chord based on said inputted information from the keys within said accompaniment key region.

10. A method for detecting chords comprising the steps of:

inputting note information representing one or a plurality of notes in a musical scale to designate a chord, firstly detecting said designated chord by detecting a chord from a root note alone or with other notes according to a predetermined detection rule based on said inputted information, said predetermined detection rule being different from a chord constituting note pattern, and secondly, if and only if said firstly detecting step has failed to detect a chord, detecting said designated chord by detecting a chord from a combination of all or some of the chord constituent notes of a chord based on said inputted information.

11. A machine readable medium for use in a chord detecting apparatus of a data processing type comprising a computer, said medium containing program instructions executable by said computer for executing:

a process of inputting note information representing one or a plurality of notes in a musical scale to designate a chord, a first chord detection process of detecting a chord from a root note alone or with other notes according to a predetermined detection rule based on said inputted information, said predetermined detection rule being different from a chord constituting note pattern, a second chord detection process of detecting a chord from a combination of all or some of the chord constituent notes of said chord based on said inputted information, and a chord detection control process responsive to the input of said note information for automatically executing said first chord detection process to detect said designated chord, and if and only if said first chord detection process has failed to detect a chord then executing said second chord detection process to detect said designated chord.

12. A chord detecting apparatus comprising:

a note information input device that inputs note information representing one or a plurality of notes in a musical scale to designate a chord, a first chord detector that detects a chord from a root note alone or with other notes according to a predetermined detection rule based on said inputted information, said predetermined detection rule being different from a chord constituting note pattern, a second chord detector that detects a chord from a combination of all or some of the chord constituent notes of said chord based on said inputted information, and a chord detection controller, responsive to the input of said note information, that automatically renders said first chord detector operative to detect said designated chord, and if and only if said first chord detector has failed to detect a chord, then renders said second chord detector operative to detect said designated chord.

* * * * *